US007003851B2

(12) United States Patent
Salice

(10) Patent No.: US 7,003,851 B2
(45) Date of Patent: Feb. 28, 2006

(54) HINGE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 10/634,444

(22) Filed: Aug. 5, 2003

(65) Prior Publication Data

US 2005/0071953 A1 Apr. 7, 2005

(30) Foreign Application Priority Data

Aug. 5, 2002 (DE) ..... 202 12 022 U

(51) Int. Cl.
*E05F 1/14* (2006.01)

(52) U.S. Cl. ..... 16/285; 16/288; 16/342; 16/366

(58) Field of Classification Search ..... 16/285, 16/286, 287, 288, 303, 307, 342, 335, 366, 16/54, 50
See application file for complete search history.

(56) References Cited

U.S. PATENT DOCUMENTS

| | | | | |
|---|---|---|---|---|
| 1,823,263 A | | 9/1931 | Fabry | |
| 4,251,900 A | * | 2/1981 | Lautenschlager | 16/294 |
| 4,485,522 A | * | 12/1984 | Chen | 16/54 |
| 4,543,686 A | * | 10/1985 | Rock et al. | 16/288 |
| 4,654,930 A | * | 4/1987 | Lautenschlager et al. | 16/288 |
| 5,008,977 A | * | 4/1991 | Lautenschlager et al. | 16/278 |
| 5,012,551 A | * | 5/1991 | Beneke et al. | 16/49 |
| 5,715,574 A | * | 2/1998 | Schall | 16/301 |
| 5,996,132 A | * | 12/1999 | Sorimachi | 4/236 |
| 6,018,847 A | * | 2/2000 | Lu | 16/337 |
| 6,164,592 A | * | 12/2000 | Stephan et al. | 244/118.1 |
| 6,336,252 B1 | * | 1/2002 | Bando | 16/307 |
| 6,389,611 B1 | * | 5/2002 | Fujita | 4/236 |
| 6,684,453 B1 | * | 2/2004 | Wang | 16/54 |

FOREIGN PATENT DOCUMENTS

| | | | |
|---|---|---|---|
| DE | 201 04 100 | | 5/2001 |
| DE | 201 02 998 | | 6/2001 |
| DE | 202 03 868 | | 5/2002 |
| EP | 50320 A1 | * | 4/1982 |
| JP | 07286472 A | * | 10/1995 |
| JP | 08184254 A | * | 7/1996 |
| JP | 10051526 A | * | 2/1998 |
| JP | 2001271553 A | * | 10/2001 |
| WO | WO01/97659 | | 12/2001 |

* cited by examiner

*Primary Examiner*—Chuck Y. Mah
(74) *Attorney, Agent, or Firm*—Dilworth & Barrese

(57) ABSTRACT

The movement of a hinge, preferably for furniture, comprising a hinge arm or a fixed-body hinge section and a pivotable hinge section flexibly connected thereto, is damped by a rotation damper at least damped over part of the closure path to the closed position. In order that the hinge can be manufactured at reduced cost, the rotation damper is an axial damper whose axis forms a hinge axis of the hinge and whose cylinder is fixedly connected to the hinge section which is pivotably supported on the axis.

12 Claims, 3 Drawing Sheets

Fig.1
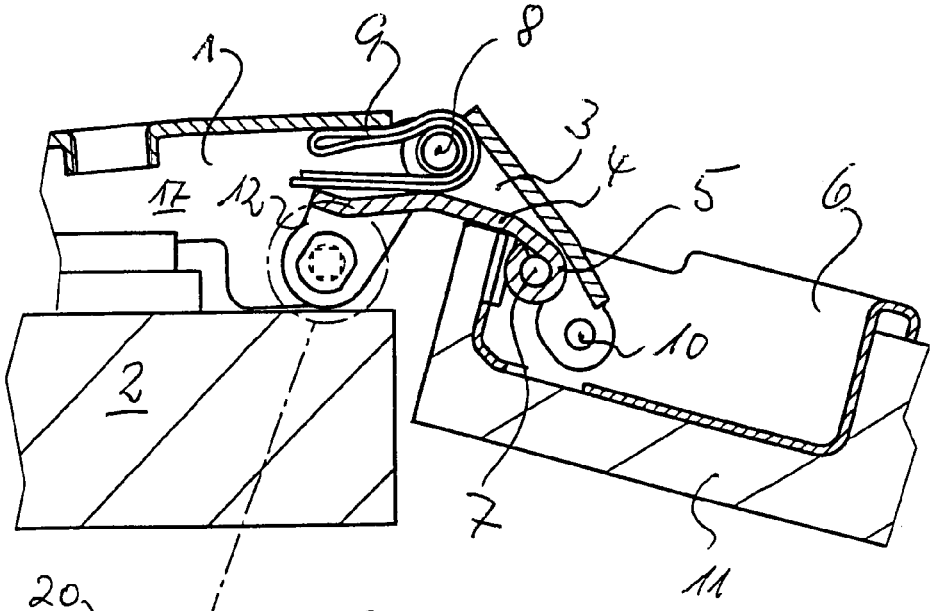
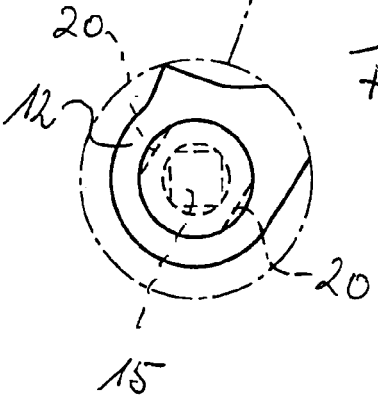
Fig.1a
Fig.2
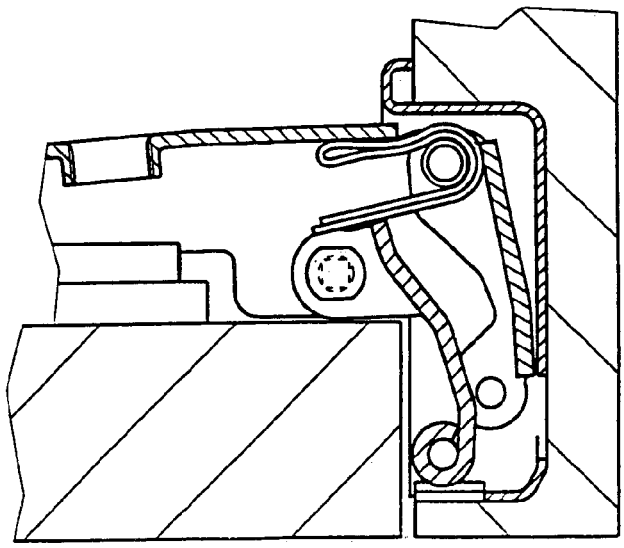

HINGE

BACKGROUND OF THE INVENTION

The invention relates to a hinge, preferably for furniture, comprising a hinge arm or a fixed-body hinge section and a pivotable hinge section flexibly connected thereto, whose movement to the closed position is at least damped over part of the closure path by a rotation damper.

Hinges of this type are known, for example, from DE 201 04 100 U1. In these known hinges, conventional rotation dampers are used wherein the rotation body damped by a damping fluid is located in a cylindrical housing and on at least one axial pin of the rotation body supported in the covers of the housing there is fixedly positioned a pinion which meshes with a toothed segment of one of the pivotable hinge sections. This known hinge can only be produced with relatively high manufacturing costs because a pinion-toothed segment arrangement is required to transmit the damping force.

SUMMARY OF THE INVENTION

The object of the invention is thus to provide a hinge of the type specified initially which can be manufactured with a reduced expenditure.

This object is solved according to the invention by the rotation damper being an axial damper whose axis forms a hinge axis of the hinge and whose cylinder is fixedly connected to the hinge section pivotably supported on the axis.

The damping device of this known hinge can be manufactured with very much lower expenditure because the axis of the axial damper forms a hinge axis of the hinge and the cylinder of the axial damper is fixedly connected to the pivotable hinge section so that the axial damper is integrated in a hinge axis of the hinge and special gearing means to transmit the damping force from the rotation damper to the pivotable hinge section are dispensed with.

Rotation dampers in the form of axial dampers suitable for incorporation in the hinge according to the invention are inherently known and are manufactured and distributed in various embodiments. Thus, a detailed description of the design of such known axial dampers is dispensed with here.

Double guide hinges can be damped particularly advantageously by axial dampers in the fashion according to the invention by the axis of the axial damper forming the joint pin of one of the four hinges and the end of the guide supported thereon being fixedly connected to the cylinder.

In a further development of the invention it is provided that one of the fixed joint pins is formed by the axis of the axial damper and the axis is thereby specified by the legs of a U-shaped hinge arm such that one end of the axis projecting beyond the cylinder has a non-circular or polygonal, e.g. square cross-section and engages in a complementary recess of one leg of the hinge arm and the other end bears a circular disk whose diameter is as large as the diameter of the cylinder which is held in a complementary hole of the other leg. In this embodiment the axial damper can be assembled in a simple fashion by sliding it through the hole until the non-circular or polygonal axial pin is inserted in the complementary recess of one leg and the circular disk is inserted in the corresponding complementary hole of the other legs. In this fashion the axis of the axial damper is held non-rotatably on the hinge arm.

According to a preferred embodiment it is provided that one of the pivotable joint pins is formed by the axis of the axial damper and an axial pin is held in a wall of the pivotable hinge section, that the cylinder is connected non-rotatably to an outer end of the guide and the other axial pin is provided with a radial extension with a hole in which the pivotable bolt of the other guide engages. Since the axis of the axial damper is held non-rotatably by the radial extension, the axial pin located at the front during insertion into the pivotable hinge section can be cylindrical.

In order that the axial damper can be inserted simply from one side between the walls of the pivotable hinge section supporting it, it is provided in a further development of the invention that the wall of the pivotable hinge section which lies opposite the wall holding the axial pin, is provided with a hole in which the end region of the cylinder of the axial damper is pivoted with clearance.

In order to fix the pushed-through axial pin of the axial damper in its recess or hole, this can be provided with a rivet head.

The pivotable hinge section or one end of a guide can easily be fixed to the cylinder of the axial damper by providing the cylinder with at least one flattened area for its fixing between the legs of a U-shaped guide or to a pivotable hinge section and providing the legs or the pivotable hinge section with a corresponding complementary recess.

BRIEF DESCRIPTION OF THE DRAWINGS

Exemplary embodiments of the invention are explained in detail below with reference to the drawings. In the figures:

FIG. 1 shows a longitudinal section through a double guide hinge with the damping device according to the invention in its opened position, FIG. 1*a* shows an enlarged view of the circled part in FIG. 1, FIG. 2 shows a diagram of the double guide hinge corresponding to FIG. 1 in its closed position.

DESCRIPTION OF THE PREFERRED EMBODIMENTS

Figure 5:
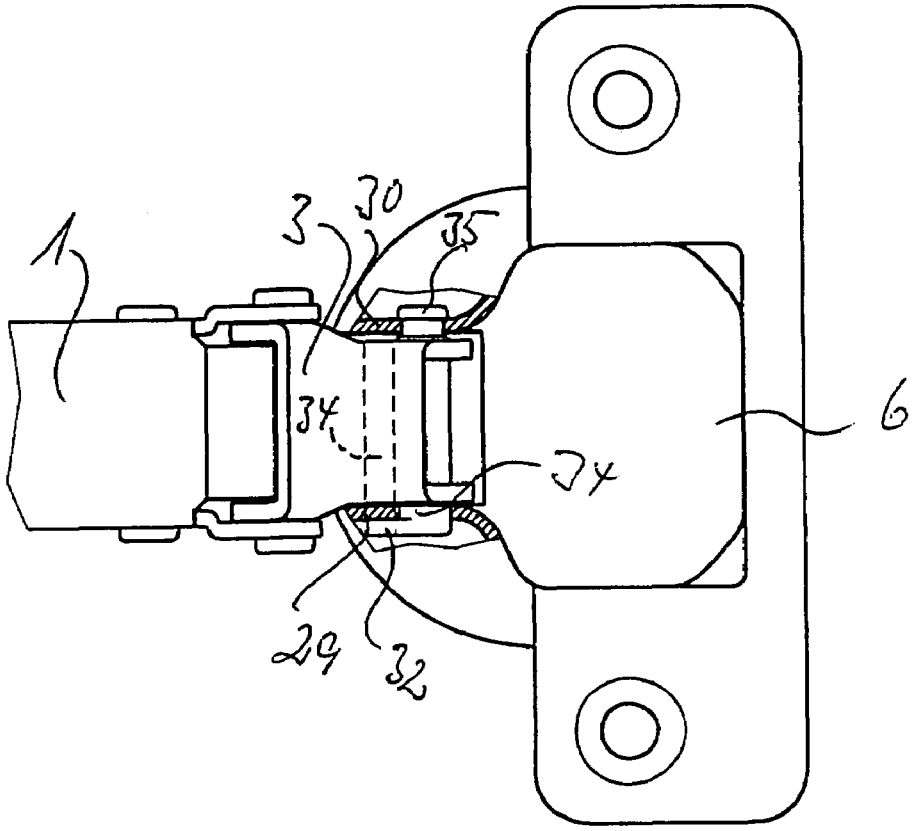
FIG. 5 shows a top view of a third embodiment of a double guide hinge with the damping device according to the invention, partly in cross-section.

The double guide hinges from FIGS. 1 and 5 comprise conventional double guide hinges which, however, have the feature that they are fitted with a rotation damper in the form of an axial damper to damp the closure movement of doors or flaps.

The double guide hinges shown in the drawings consist of a U-shaped hinge arm 1 made of Zamak or a stamped metal part, which is affixed to a cupboard wall or a body section 2 in a usual fashion. Supported between the legs of the hinge arm 1 are the ends of guides 3, 4 of which the guide 3 at both its ends and the guide 4 at its rear end are provided with U-shaped, inclined bearing lugs which are provided with holes. At its outer end the guide 3 is provided with a rolled-up eye 5 which is supported on a bolt 7 held in the hinge cup 6. On the bearing bolt 8 which is held between the legs of the hinge arm 1 and on which the inner end of the outer guide 3 is supported, there is mounted a double hairpin-shaped curved leaf spring 9 which is supported with its one leg on the web section of the hinge arm 1 and with its other leg on a control curve constructed at the inner end of the inner guide 4. The outer end of the outer guide 3 is supported on a bolt 10 held in the hinge cup 6. The hinge cup 6 is fixed as shown in a blind hole of a door or flap 11. In this respect the double guide hinges shown in the drawing are of known design so that a more detailed description can be dispensed with.

Figure 3:
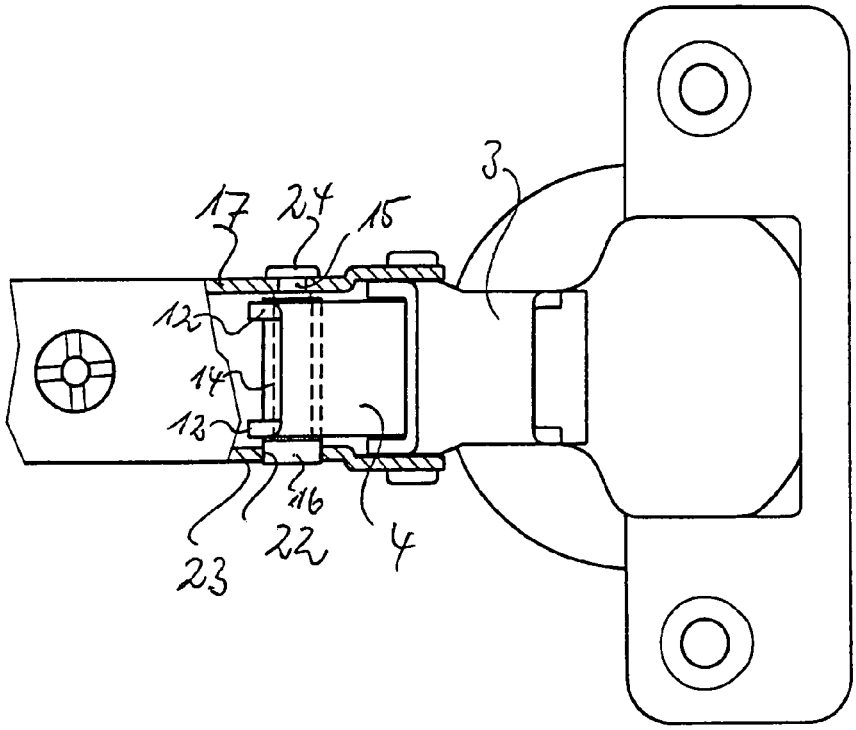
FIG. 3 shows a top view of the double guide hinge from FIG. 1, partly in cross-section.
Figure 6:
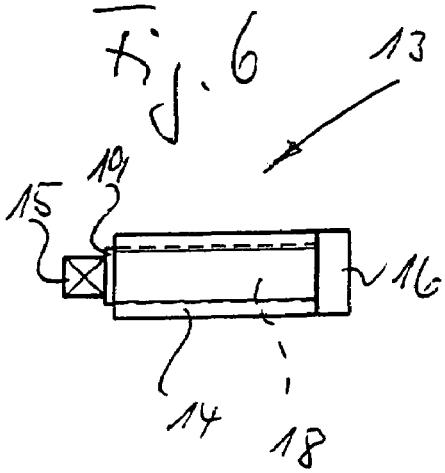
FIG. 6 shows a side view of the axial damper as can be used in the embodiments from FIGS. 1 to 4.

In the exemplary embodiment from FIGS. 1 to 3 the inner end of the inner guide 4 is supported via the lugs 12 bent from it in a U-shaped fashion on an axial damper 13, which is shown in detail in FIG. 6 and whose axial pins 15, 16 which project beyond the cylinder 14 at both ends, are held in the legs of the hinge arm 1. The leg 17 of the hinge arm 1 located at the back in FIG. 1 is provided with a square opening in which the square axial pin 15 of the axial damper 13 matched thereto and inserted therein is held non-rotatably. Adjacent to the square axial pin 15 the axis 18 of the axial damper 13 is provided with an annular step 19 via which the axis 18 is supported on the edge of the square opening in the rear leg 17 of the hinge arm 1. The cylinder 14 of the axial damper 13 is provided with flattened areas 20 on the opposite sides. The lugs 12 of the inner guide 4 are provided with openings corresponding to the profile of the cylinder 14 so that the axial damper 13 can be slid through these openings such that the inner guide 4 is connected non-rotatably to the cylinder 14. In order to allow the axial damper 13 to be slid through the lugs 12, on the right axial pin of the axial damper 13 which can be seen from FIG. 6 there is placed a circular disk 16 which is held in a complementary hole 22 of the front leg 23 of the hinge arm 1. The diameter of the disk 16 corresponds to the diameter of the cylinder 14 or is slightly larger than this. In order to fix the axis 18 of the axial damper 13 the end of the square axial pin 15 which passes through the square opening in the leg 17 is provided with a rivet head 24.

Figure 4:
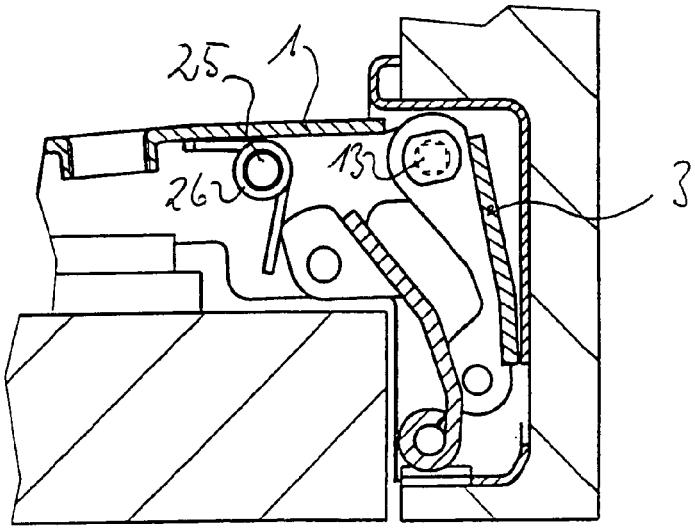
FIG. 4 shows a longitudinal section through a second embodiment of a double guide hinge with the damping device according to the invention in the closed state.

In the exemplary embodiment from FIG. 4 the inner end of the outer guide 3 is supported between the legs of the hinge arm 1 on an axial damper 13 in the fashion described with reference to FIGS. 1 to 3 and 6. Since in the exemplary embodiment from FIG. 4 the closing spring cannot be held on the axis formed by the axial damper, between the legs of the hinge arm 1 there can be arranged an additional bolt 25 on which a spring clip 26 can be mounted.

Figure 7:
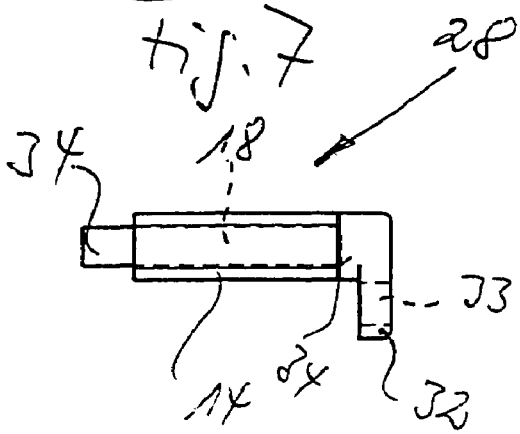
FIG. 7 shows a side view of the axial damper built into the double guide hinge from FIG. 5.

In the exemplary embodiment from FIG. 5 the outer end of the outer guide 3 is supported between the walls 29, 30 of the hinge cup 6 on an axis which is formed by the axial damper 28 which can be seen from FIG. 7. The cylinder 14 of the rotation damper 28 is held non-rotatably in the fashion described in openings of the lugs bent in a U shape from the web section of the guide 3. The right axial pin of the axial damper 28 which can be seen from FIG. 7 is provided with a radial extension 32 which is provided with a hole 33 into which engages one end of the bearing bolt 34 on which the rolled-up eye 5 of the inner guide 4 is supported on the hinge cup 6. Since the axis 18 of the axial damper 28 is held non-rotatably by the radial extension 32, the other axial pin 34 of the axial damper 28 can be constructed as round and inserted in a hole in the wall 30 of the hinge cup 6. The axial pin 34 is again provided with a rivet head 35 to hold it.

In order that the axial damper 28 can be slid from the slide-in side formed by the wall 29 of the hinge cup 6 between the walls of the hinge cup 6 and the lugs of the outer guide 3, the wall 29 situated opposite the wall 30 of the hinge cup 6 which holds the axial pin 34, is provided with a hole in which a cylindrical disk-shaped section 34 is held, which is connected non-rotatably to the axis 18, is constructed integrally with the extension 32 and whose diameter is at least as large as the diameter of the cylinder 14.

What is claimed is:

1. A double guide hinge, comprising a hinge arm (1) or a fixed-body hinge section and a pivotable hinge section (6) flexibly connected to the hinge arm (1), whose movement to a closed position is at least damped over part of a closure path by a rotation damper, two separate guides (3, 4) coupling said hinge arm (1) and pivotable hinge section (6) together, and four hinge joints or axes (7, 8, 10, 13; 28) at which said guides (3, 4) are mounted upon said respective hinge arm (1) or pivotable hinge section (6), wherein the rotation damper is formed as an axially-extending damper (13, 28) having an axis (18) forming one of the hinge axes of the hinge and having a cylinder (14) fixedly connected to the hinge section (6) which is pivotably supported on said axis (18), and said axis (18) of said axial damper (13, 28) forms a joint pin of a first one of said four hinge joints or axes (7, 8, 10, 13; 28) with an end of a one of said hinge guides (3, 4) supported thereon being fixedly connected to said cylinder (14).

2. The hinge according to claim 1, wherein said cylinder (14) is provided with at least one flattened section (20) for fixing between legs or lugs of said guide (4) which is U-shaped and the legs or lugs are each provided with a corresponding complementary recess.

3. The hinge according to claim 1, wherein a first one (4) of said guides (3,4) having an inner end being fixedly connected to said cylinder (14), an opposite end of said first guide (4) being supported upon said pivotable hinge section (6) at a second joint or axis (7) of said four hinge joints or axes (7, 8, 10, 13; 28), and a second one (3) of said guides (3,4) having an outer end supported upon said pivotable hinge section (6) at a third joint or axis (10) of said four hinge joints or axes (7, 8, 10, 13; 28) and an inner end supported upon said hinge arm (1) at a fourth joint or axis (8) of said four hinge joints or axes (7, 8, 10, 13; 28).

4. The hinge according to claim 3, wherein said hinge arm (1) being U-shaped and comprising a pair of extending legs (17, 23), the joint pin formed by said axis (18) of said axial damper (13) is fixed between the legs (17, 23) of said hinge arm (1) such that one end (15) of said axis (18) which projects beyond said cylinder (14) has a non-circular or polygonal cross-section and engages in a complementary recess of one leg (17) of the hinge arm (1) and the opposite end (16) protruding from the cylinder (14) bears a circular disk (16) whose diameter is at least as large as diameter of said cylinder (14) and which is held in a complementary hole (22) of the other leg (23) of the hinge arm (1).

5. The hinge according to claim 4, wherein the axial pin (15, 34) of said axis (18) of said axial damper (13, 18) inserted through the holes or recesses of both legs of the U-shaped hinge arm (1) is provided with a rivet head (24, 35).

6. The hinge according to claim 4, wherein said cylinder (14) has a square cross-section.

7. The hinge according to claim 3, wherein said guides (3, 4) each comprise substantially U-shaped, inclined bearing lugs, with said second joint (7) being constituted by a bolt (7) held upon said hinge section (6) and said first guide (4) comprising a rolled-up eye (5) at an outer end thereof and supported about said bolt (7), said third joint (10) being constituted by a bolt (10) held on said hinge section (6) and the outer end of said second guide (3) being supported upon said bolt (10), and said fourth joint (8) being constituted by a bearing bolt (8) retained between legs (17, 23) of said hinge arm (1) and on which the inner end of said second guide (3) is supported.

8. The hinge according to claim 7, wherein said pivotal hinge section (6) is in the shape of a hinge cup.

9. The hinge according to claim 7, additionally comprising a double hairpin-shaped curved leaf spring (9) having two legs and mounted about said fourth joint bearing bolt (8) and supported with one leg thereof on a web section of said hinge arm (1) and another leg thereof on a control curve situated at the inner end of said first guide (4).

10. The hinge according to claim 1, wherein one end of the joint pin formed by said axis (18) of said axial damper (28) is held in a wall (30) of said pivotable hinge section (6), the cylinder (14) is non-rotatably connected to one outer end of one of the guides (3,4) and the other end of the axial pin is provided with a radial extension (32) with a hole (33) in which a pivotable bolt (34) of the other guide (4) engages.

11. The hinge according to claim 10, wherein a wall (29) of said pivotable hinge section (6), located opposite said wall (30) of the pivotable hinge section (6) holding the pivotal bolt (34), is provided with a hole in which a cylindrical disk-shaped section of the pivotal bolt (34) is non-rotatably mounted, said disk-shaped section is constructed integrally with said extension (32) and whose diameter is at least as large as the diameter of said cylinder (14).

12. The hinge according to claim 1, wherein said hinge arm (1) is additionally U-shaped and has a pair of extending legs (17, 23), and comprising an additional bolt (25) arranged between the legs of the hinge arm (1) on which a spring clip (26) is mounted.

* * * * *